US006332249B1

(12) United States Patent
Oda et al.

(10) Patent No.: US 6,332,249 B1
(45) Date of Patent: Dec. 25, 2001

(54) SLIDER FOR SLIDE FASTENER WITH LOCKING MECHANISM

(75) Inventors: Kiyoshi Oda; Koji Yamagishi, both of Toyama-ken (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 09/574,350

(22) Filed: May 19, 2000

(30) Foreign Application Priority Data

May 31, 1999 (JP) ..... 11-152397

(51) Int. Cl.[7] ..... A44B 19/30

(52) U.S. Cl. ..... 24/421; 24/420; 24/424; 24/423

(58) Field of Search ..... 24/420, 421, 422, 24/423, 424, 418, 416, 425

(56) References Cited

U.S. PATENT DOCUMENTS

| | | | | |
|---|---|---|---|---|
| 2,222,529 | * | 11/1940 | Dahlin | 24/424 |
| 2,654,931 | * | 10/1953 | Voity | 24/421 |
| 2,657,445 | * | 11/1953 | Weber | 24/421 |
| 2,689,390 | | 9/1954 | Firing . | |
| 2,705,356 | * | 4/1955 | Mikulas | 24/421 |
| 2,779,078 | * | 1/1957 | Morin | 24/424 |
| 2,983,018 | * | 5/1961 | Stone | 24/421 |
| 3,050,804 | * | 8/1962 | Morin | 24/423 |
| 3,368,249 | | 2/1968 | Fukuroi . | |
| 4,422,220 | | 12/1983 | Oda . | |

FOREIGN PATENT DOCUMENTS

| | | |
|---|---|---|
| 0 839 466 A1 | 5/1998 | (EP) . |
| 2 184 779 A | 7/1987 | (GB) . |

* cited by examiner

*Primary Examiner*—Robert J. Sandy
(74) *Attorney, Agent, or Firm*—Finnegan, Henderson, Farabow, Garrett & Dunner, L.L.P.

(57) ABSTRACT

The present invention provides a slider with a simple locking mechanism which allows the slider to be operated easily and exerts its locking function accurately. In the slider of this invention, a recess is made in the center of an upper wing plate of a slider body thereof and engaging posts are provided on the front and back of the slider body. Two pawl holes are provided in a bottom portion of the recess and supporting pieces are provided on the right and left sides so as to be erected. Guide grooves are provided in side walls of the recess. A pawl body comprises locking pawls provided on the right and left of a bottom face thereof in which a top face thereof is formed in a mountain shape and their phases are deviated by half pitch and guide protruding portions protruding from the side walls. A pull tab has a pintle on an end thereof and a cam is provided in the center of the pintle. A cover is a rectangular prism and has front and rear engaging holes which are capable of engaging the engaging posts. The guide protruding portions of the pawl body are inserted into the guide grooves of the recess and the pull tab is placed on the supporting pieces from above. Then, the cover is mounted. When the pull tab is raised or hung, the pawl body moves up and down, so that the locking pawls enter in between fastener elements by pressure.

9 Claims, 10 Drawing Sheets

SLIDER FOR SLIDE FASTENER WITH LOCKING MECHANISM

BACKGROUND OF THE INVENTION

1. Field of the Invention

The present invention relates to a slider with locking mechanism for use in ordinary slide fasteners, and more particularly to a slider for slide fastener with locking mechanism whose pawl body having locking pawl is actuated to operate the locking mechanism when a pull tab is raised or hung by using a repellent force of the fastener element, without use of any spring.

2. Description of the Related Art

A conventional example for a slider for slide fastener with locking mechanism of this kind is disclosed in Japanese Utility Model Publication No. 45-2165, as shown in FIG. 15. A cut-out is provided by cutting out the center of the surface of an upper wing plate 005 of a slider body 001 in a curved shape, and a pawl hole 013 is provided at a deviated position of the bottom portion of this cut-out. A leaf spring is disposed in the cut-out such that it moves freely and has a U-shaped protruding portion provided in the center thereof, which is capable of entering or escaping from the pawl hole 013 freely. An end of the leaf spring is fixed in a concave portion 011 provided at an end portion of the cut-out. Then, a cam 030 provided on a top portion of a pull tab 003 journalized by a post provided in the upper wing plate 005 is brought into contact from above. By raising or hanging the pull tab 003, the U-shaped protruding portion of the leaf spring is made to protrude in between fastener elements on one side so as to lock the slider.

According to Japanese Patent Application Laid-Open No. 10-127312, a slider for slide fastener having locking mechanism as shown in FIG. 16 has been disclosed. The slider comprises a slider body 101, swing plate, cover 104 and pull tab 103. A recess 111 is provided in a top surface of the upper wing plate 105, a pawl hole 113 is formed on one side in the rear side of the recess 111 and a hook-shaped cover mounting post 118 is provided on front and back, a bearing projecting portion 114 is provided on both sides, the swing plate is formed of a sheet body curved in a gentle V shape, a step is provided for preventing a contact of the cam 130 on the rear surface thereof, and a circular head portion facing downward is provided on one end and a lock projecting portion 124 deviated to one side is provided on the other end. A cam 130 is provided integrally in the center of a pintle on one end of the pull tab 103 and an end of the cam 130 is deviated toward a front end with respect to the axis of the pintle of the pull tab 103. Then, the swing plate is disposed within the recess 111. The pintle of the pull tab 103 is placed on the bearing projecting portion 114 from above, so that the cam 130 is brought into contact with the rear surface of the swing plate and then, the cover 104 is mounted on the mounting posts 118. A projecting piece provided on the cover 104 is brought into contact with the circular head portion of the swing plate. As a result, the swing plate is prevented from floating up freely to lose the locking function when the pull tab 103 is hung.

In the slider for slide fastener with locking mechanism shown in FIG. 15 described above, when considering a contact point between the cam 011 of the pull tab 003 and leaf spring, there may be a problem that when the locking function is actuated by hanging the pull tab 003, the pull tab 003 may jump up due to a force which pushes up the U-shaped protruding portion by engaging elements and a restoration force of the leaf spring i.e. a sliding backward thereof, which makes the locking function unstable. Further, because the protruding portion of the leaf spring is only curved in a U shape, it is easily deformed so that a secure locking function cannot be expected.

In the slider for slide fastener with locking mechanism shown in FIG. 16, when the swing plate is pressed by the cam 130 so that a lock projecting portion 124 formed on the swing plate is pressed into coil-shaped fastener elements, there is a large gap between the lock projecting portion 124 for receiving a repellent force from the fastener element and a contact portion between the cam 130 and swing plate. Therefore, the swing plate is twisted around the contact portion with the cam 130 by a repellent force of the fastener elements, so that it is deformed, thus the lock projecting portion 124 is unable to carry out a sufficient locking action for the fastener elements. Further, the lock projecting portion 124 of the swing plate is deviated to one side, so that the locking function is actuated by only the fastener elements on one side. As a result, the locking function cannot be exerted uniformly to the right and left sides.

SUMMARY OF THE INVENTION

The present invention has been achieved in views of the above described problems, and therefore, an object of the present invention is to provide a slider for slide fastener with locking mechanism in which a locking mechanism of the slider is different from a conventional slider such that the locking mechanism is actuated at right-angle to fastener element row by raising or hanging operation of a pull tab and has a rigid structure thereby ensuring a sufficient locking performance.

Another object of the present invention is to provide a slider for slide fastener with locking mechanism in which the locking mechanism is formed in a structure suitable for reduction of the size so that the slider itself can be reduced in size and allowing smooth operation thereof.

Still another object of the present invention is to provide a slider for slide fastener with locking mechanism in which by specifying a relation between the cam of the pull tab and pawl body in the locking mechanism, the locking mechanism is prevented from being released unintendedly, and once the locking mechanism is released, it is never activated unless an intended locking operation is carried out.

A further object of the present invention is to provide a slider for slide fastener with locking mechanism in which the locking mechanism is deviated to both the right and left with respect to the center of the slider so that they coincide with the right and left fastener element rows, thereby activating uniformly to the right and left sides to achieve an excellent locking function.

A further object of the present invention is to provide a slider for slide fastener with locking mechanism in which the locking mechanism is provided in the center of the slider so that it is activated equally to a coupling head side of any of the right and left fastener element rows, thereby achieving an excellent locking function.

Another object of the present invention is to provide a slider for slide fastener with locking mechanism in which by moving the pull tab forward or backward, the locking mechanism is activated smoothly at the forward and backward positions so that an excellent locking function can be exerted.

Still another object of the present invention is to provide a slider for slide fastener with locking mechanism in which components of the slider, that is, the slider body, pawl body, cover and pull tab are molded of the same material of thermoplastic resin or metal so as to be recycled.

An object of the present invention is to provide a slide fastener with a slider with locking mechanism in which the locking mechanism is activated effectively and appropriately, and the locking mechanism can be released easily by a repellent action of a deformation of the coil-shaped fastener elements.

To achieve these objects, there is provided a slider for slide fastener with locking mechanism, wherein a recess is provided in the surface of an upper wing plate of a slider body; pawl holes for locking pawls are made in a bottom portion of the recess; a pawl body having the locking pawls on a bottom thereof so as to protrude is mounted to the recess movable vertically so that the locking pawls are capable of entering or escaping from the slider body freely through the pawl holes; and a pull tab is supported by supporting pieces such that a cam provided on an end of the pull tab is kept in contact with a top face of the pawl body opposite to a face in which the locking pawls are provided.

Preferably, there is provided a slider for slide fastener with locking mechanism, wherein a guide protruding portion is provided on side wall of the pawl body such that it protrudes; a guide groove is provided in side wall of the recess or recess and supporting pieces vertically; and the guide protruding portions are inserted into the guide grooves slidable freely so that the pawl body is capable of moving vertically.

Further preferably, there is provided a slider for slide fastener with locking mechanism, wherein the top face of the pawl body has a slope provided on one of front or rear half with respect to the top face, therefore, when the pull tab is hung, the surface of the cam moves along the slope the pawl body can be engaged loosely toward the fastener element. When the pull tab is raised, surface of the cam moves along the slope so that the engagement between pawl body and fastener element can be released quickly. Therefore, movement of the pawl body by the hanging and raising operation of the pull tab can be operated smoothly.

It is still preferable that there is provided a slider for slide fastener with locking mechanism, wherein the top face of the pawl body is formed in a mountain shape protruding along a horizontal line in the center so as to form a vertex. Therefore, there will exist no front/back direction on the pawl body so that there is no need to confirm front and back of the pawl body when assembling the slider, and operational efficiency will improve.

It is further preferable that there is provided a slider for slide fastener with locking mechanism, wherein one face of the cam of the pull tab is formed substantially linear while the other face is formed in an arc-shape. When the pull tab is fallen to the rear side, a front end of the cam rides over the vertex. Therefore, even if a repellent force of element to the pawl body is applied on the surface of the cam, the repellent force works on the direction to maintain the fallen state of the pull tab, namely on the direction which maintains the engagement between pawl body and element, the engagement will not be released unless the user picks up and operate (raise) the pull tab.

Further preferably, the is provided a slider for slide fastener with locking mechanism, wherein the top face of the pawl body on an opposite side to a face in which the locking pawls are provided is formed in a mountain shape protruding along a horizontal line in the center so as to produce a vertex; one face of the cam provided on one end of the pull tab is formed substantially linear while the other face is formed in an arc shape. When the pull tab is hung to the back side of the slider body, a front end of the cam rides over the vertex, so that when the surface of the cam moves along the slope, the pawl body can be engaged loosely toward the fastener element. When the pull tab is raised, the cam makes contact with slopes of the top face of the pawl body to be biased so that the pull tab cannot be fallen freely. Further, when the pull tab is raised, surface of the cam moves along the slope so that the engagement between the pawl body and the element can be released quickly. Therefore, movement of the pawl body by the hanging and raising operations of the pull tab can be operated smoothly.

Further preferably, there is provided a slider for slide fastener with locking mechanism, wherein a partitioning portion is provided in a longitudinal direction in the center of an inner face of the upper wing plate of the slider body so as to protrude in order to partition right and left fastener elements; pawl holes are made on both sides of the protruding partitioning portion in parallel on the bottom portion of the recess; the locking pawls are provided in parallel so as to protrude from both sides except a longitudinal direction in the center of a bottom face of the pawl body, which is an opposite face to the top face of the pawl body, and the locking pawls and pawl holes are disposed so as to oppose each other.

It is preferable that there is provided a slider for slide fastener with locking mechanism, wherein the locking pawls protruded in parallel on the right and left sides at the bottom surface of the pawl body are deviated by half pitch corresponding to one pitch of each of right and left fastener elements between the left and right locking pawls.

It is preferable that there is provided a slider for slide fastener with locking mechanism, wherein a partitioning portion is provided in a longitudinal direction in the center of an inner face of the upper wing plate of the slider body so as to protrude in order to partition the right and left fastener elements; a pawl hole is made in the protruded partitioning portion in the bottom portion of the recess; a locking pawl is provided in a bottom face of the pawl body, which is an opposite face to the top face of the pawl body so as to protrude; and the locking pawl and pawl hole are disposed so as to face each other.

It is further preferable that there is provided a slider for slide fastener with locking mechanism, wherein cams provided on an end of the pull tab to be mounted to the slider body are formed such that they protrude from both front and rear surfaces of the pull tab symmetrically with respect thereto, in other words, linear face corresponds to linear face, and arc-shaped face corresponds to arc-shaped face, and are capable to be in contact with both front and rear slopes formed on the top face of the pawl body when the pull tab is fallen forward or backward.

DESCRIPTION OF THE PREFERRED EMBODIMENTS

Hereinafter, the preferred embodiments of the slider for slide fastener with locking mechanism of the present invention will be described in detail with reference to the accompanying drawings.

Figure 1:
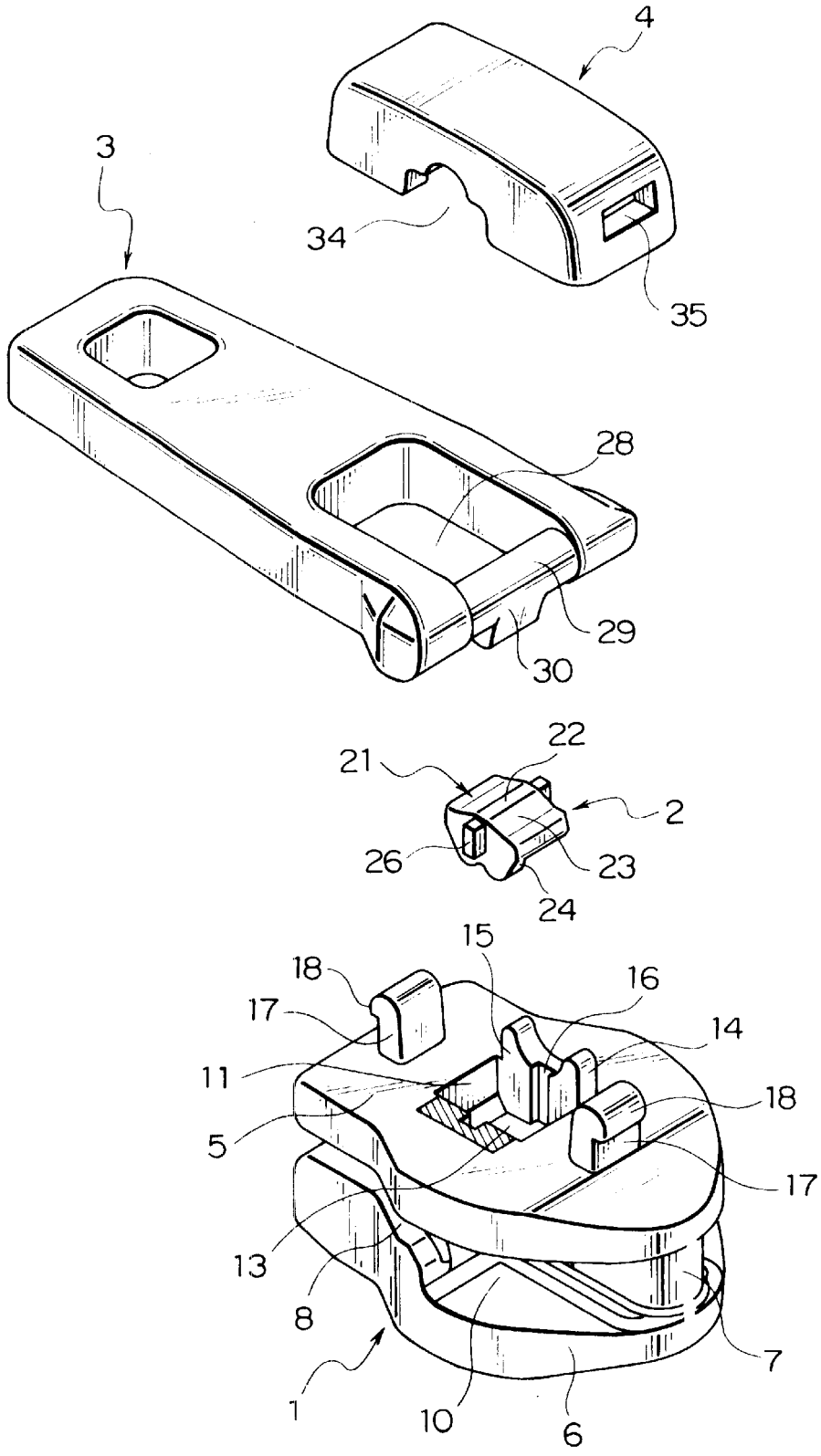
FIG. 1 is an exploded perspective view of a slider with locking mechanism according to a first embodiment.

A slider for slide fastener with locking mechanism of the present invention is a normal type slider having a locking function as shown in FIG. 1. The slider comprises of four members : a slider body 1, a pawl body 2, pull tab 3 and cover 4, which are molded by injection molding or extrusion molding of thermoplastic resin such as polyamide, polyacetal, polypropylene, polybutylene terephthalate or the like or one of these resins with abrasive resistant reinforcement agent. Further, these components may be molded by die-cast molding of metal such as aluminum alloy and zinc alloy. Although the slider may be assembled by combination of metallic members and resin members, it is preferable to mold four members : the slider body 1, pawl body 2, pull tab 3 and cover 4 of the same material.

In the slider of the first embodiment shown in FIGS. 1 to 7, the slider body 1, pawl body 2, pull tab 3 and cover 4 are all molded of the same thermoplastic resin material. In the slider body 1, an upper wing plate 5 and a lower wing plate 6 are connected with a guide post 7, and guide flanges 8 for guiding fastener elements E, particularly coil-shaped fastener elements E are provided so as to protrude on both side edges of the lower wing plate 6. A partitioning portion 9 for partitioning right and left coil-shaped fastener elements E is provided in the center of an inner face of the upper wing plate 5 along the longitudinal direction thereof and sliding grooves 10 for the coil-shaped fastener elements are provided between the upper wing plate 5 and lower wing plate 6. Then, a recess 11 is provided in the center of a top surface of the upper wing plate 5. This recess 11 is formed such that a bottom portion 12 side thereof is relatively narrow. Two pawl holes 13 are made in the bottom portion 12 such that two locking pawls 24 provided on a bottom face of the pawl body 2 can be inserted. The pawl holes 13 are disposed in parallel to each other on both sides of the partition wall 9 in the center portion.

Supporting pieces 14 for mounting a pintle 29 of the pull tab 3 are provided so as to protrude on both the right and left sides of the recess 11 provided in the top surface of the slider body 1. A top face of the supporting piece 14 is formed in an arc shape so as to mount the pintle 29. Further, concave guide grooves 16 are made vertically in both side walls 15 of the recess 11 toward the pawl hole 13. The guide grooves 16 extend up to internal faces of the supporting pieces 14 adjoining the recess 11. Then, engaging posts 17 are provided on the front and back of the upper wing plate 5 of the slider body 1 such that they oppose each other so that a cover 4 can be set thereon by snap action. An outward facing hook portion 18 is provided at a front end of each of the engaging posts 17 and capable of engaging an engaging hole 35 provided in the cover 4.

Figure 2:
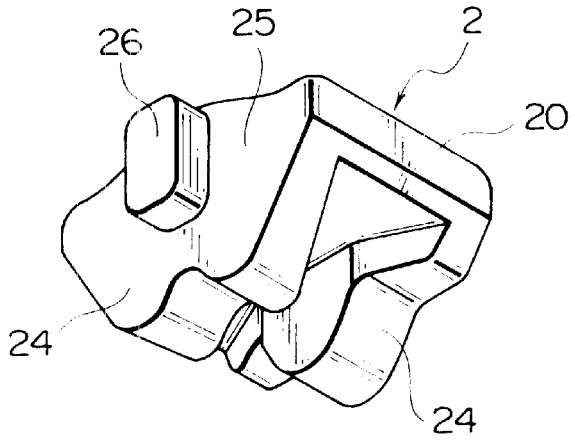
FIG. 2 is a perspective view of a pawl body of the same slider.
Figure 3:
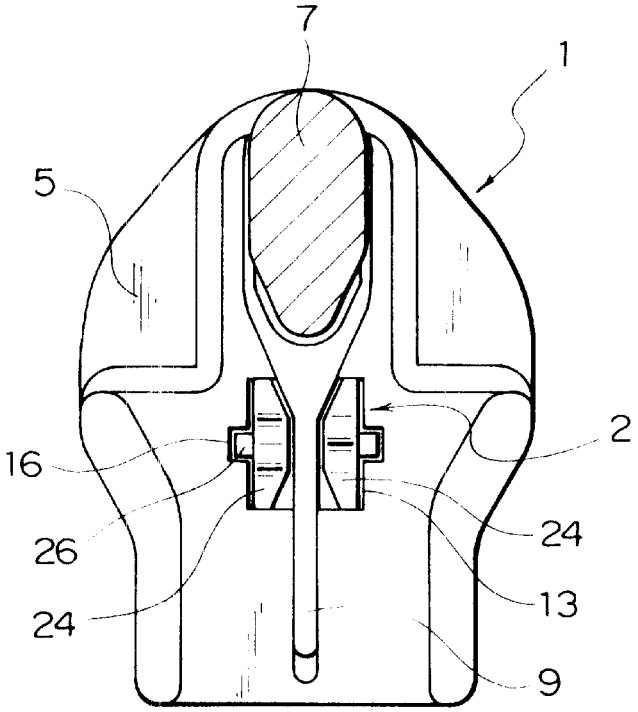
FIG. 3 is a sectional view showing an inner structure of an upper wing plate of the same slider.

As shown in FIGS. 1 and 2, the pawl body 2 is formed of a base portion 20 in which a bottom face thereof is flat and a top face 21 thereof is formed in a mountain shape protruding along a horizontal line so as to form a vertex 22. Slopes 23 are formed on both sides of the front and back with respect to the vertex 22. An end portion of the slope 23 is formed in a horizontal shape and the slope 23 is formed so that the cam 30 provided on the pull tab 3 can make contact therewith. Locking pawls 24 are provided in parallel on both right and left side edges of the base portion 20 such that they are directed downward. A tip of each of these locking pawls 24 is formed in a gradually narrowed shape. The right and left locking pawls 24 are deviated by half pitch with each other so that they are formed to correspond to a pitch of the right and left coil-shaped fastener elements E. Further, as shown in FIG. 3, entrances of the front and back of the locking pawls 24 which face each other are formed to be wide.

A guide protruding portion 26 is provided such that it protrudes in the vertical direction of the base portion 20 from the top portion of an outer face up to the base portion 20 of a side wall 25, or locking pawls 24 of the pawl body 2. This guide protruding portion 26 is inserted into the recess 11 in the slider body 1 and the concave guide grooves 16 provided in the side wall 15 of the supporting piece 14 so that the pawl body 2 is capable of moving up and down with respect to the slider body 1 and the locking pawls 24 are capable of entering or escaping from the sliding groove 10 freely. As a result, the right and left coil-shaped fastener elements E inserted through the sliding groove 10 of the slider body 1 are pressed by the locking pawls 24 or pressed up by a repellent force of the coil-shaped fastener elements E.

The pull tab 3 may be formed in a rectangular shape or other arbitrary shape as shown in FIG. 1, but a concave hole 28 should be provided at an end of the pull tab 3 so that the cover 4 can be inserted therein and the pull tab 3 can be raised or hung freely, and the pintle 29 should be provided so that it can be mounted on the supporting piece 14 of the slider body 1. A cam 30 having a substantially the same width as a lateral width of the top face 21 of the pawl body 2 is provided in the center of this pintle 29 such that it protrudes at right angle with respect to the pull 3. Consequently, the cam 3 is capable of making contact with the top face 21 of the pawl body 2.

Figure 6:
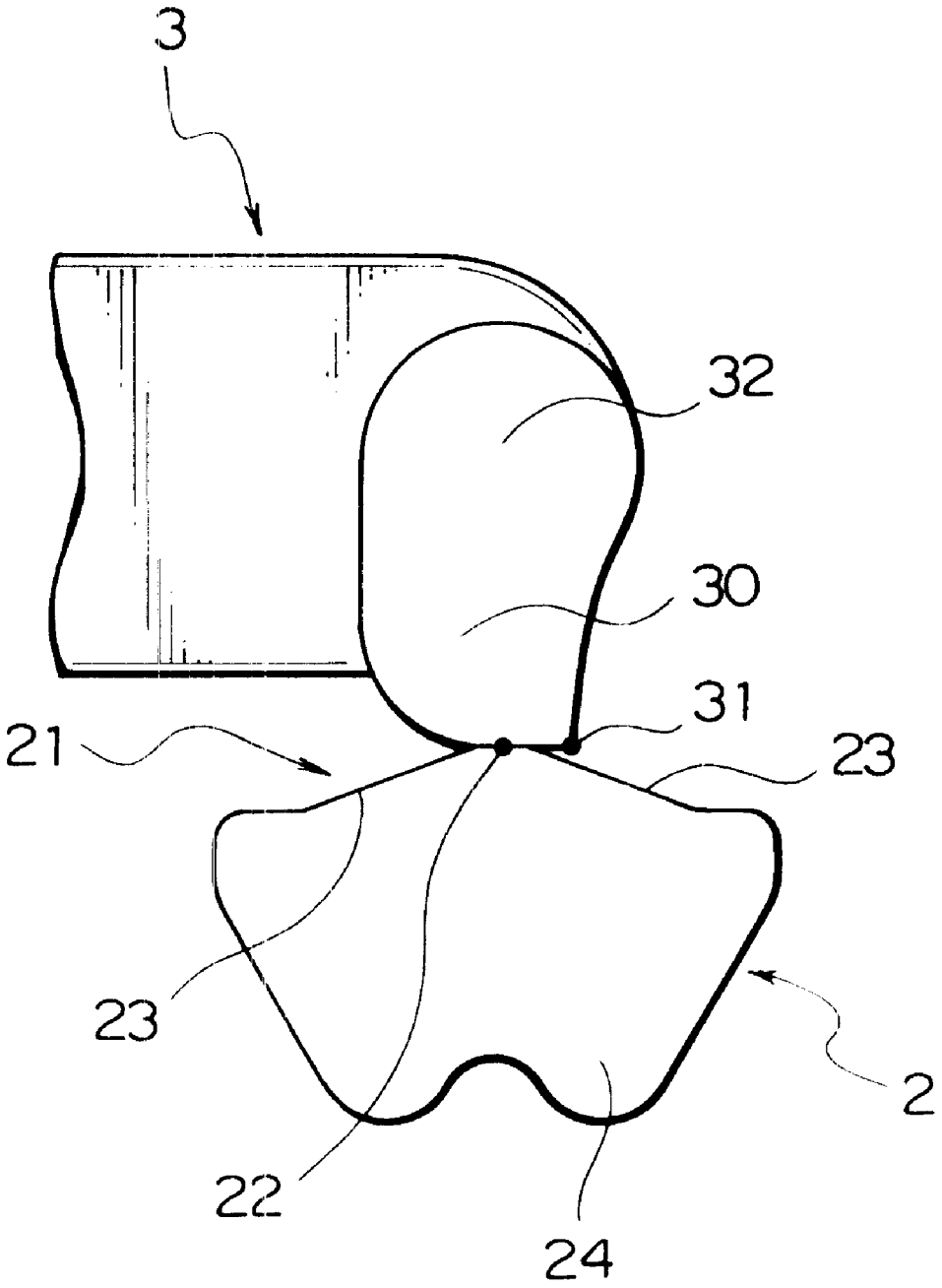
FIG. 6 is an explanatory diagram showing a relation between a cam and a pawl body of the slider.
Figure 7:
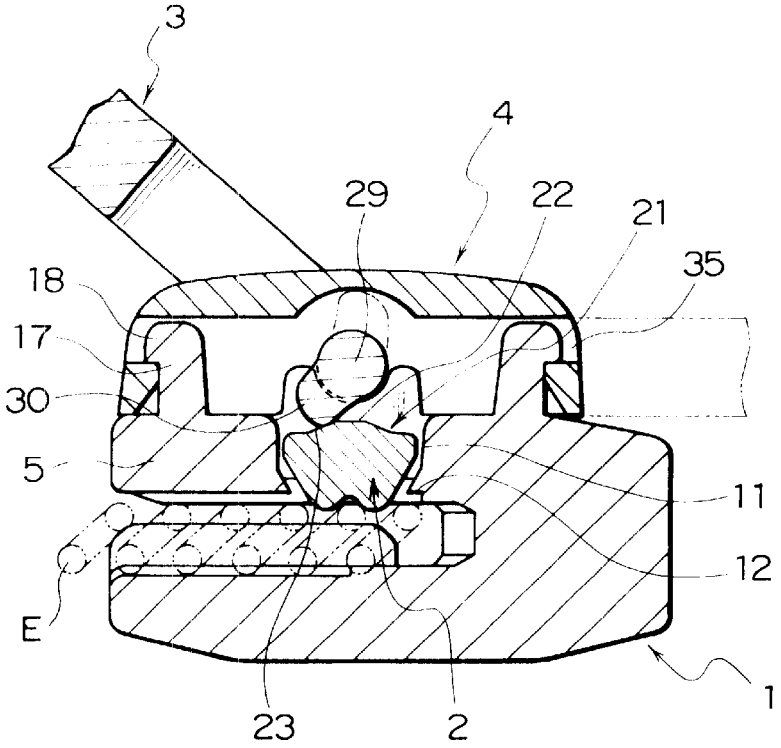
FIG. 7 is a longitudinal sectional view showing a state in which the locking mechanism of the slider is released.

A sectional shape of the cam 30 of the pull tab 3 is similar to a side shape of the thumb such that the front side is substantially linear while an inner side is in an arc-shape. As shown in FIG. 6, when the pull tab 3 is hung onto a top surface on the rear side of the slider body 1, a front end 31 of the cam 30 located at a position most farther to an axis 32 of the pintle 29 of the pull tab 3 presses down the pawl body 2 and rides over the vertex 22 so that it is deviated forward of the slider body 1 more than the axis 32 of the pintle 29. Because a force of the fastener element E pressing up the pawl body 2 is applied from the vertex 22 of the pawl body 2 vertically to the axis 32 of the pintle 29, unless a force for pressing down the pawl body 2 is applied again, in other words, an action of raising the pull tab 3 is carried out, the front end 31 never returns beyond the vertex 22, so that the pawl body 2 is capable of entering in between the fastener elements E with a pressure and keep the stable condition.

Figure 4:
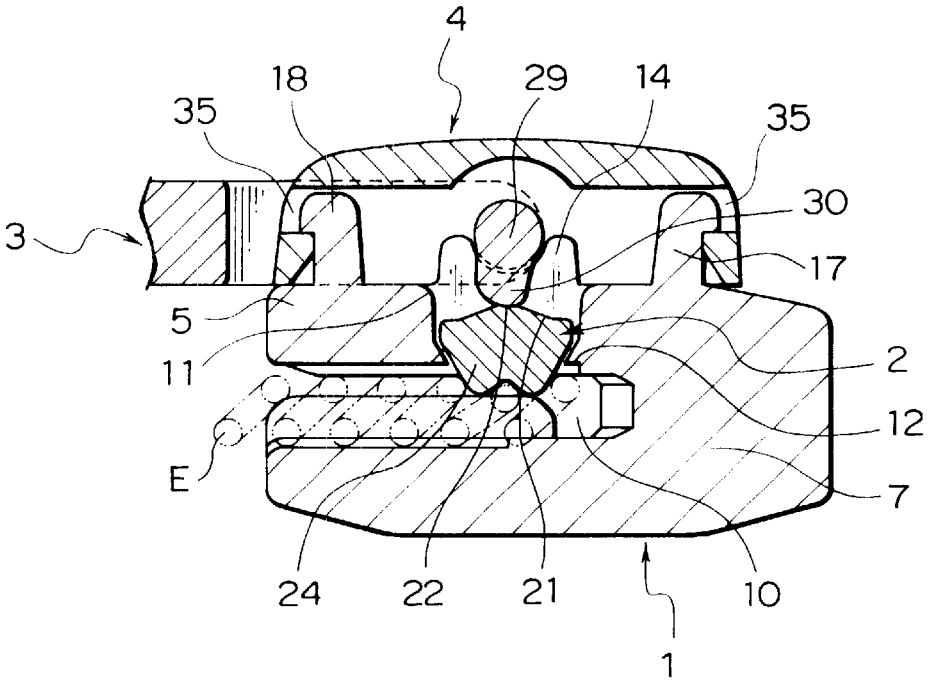
FIG. 4 is a longitudinal sectional view showing a state in which the locking mechanism of the slider is actuated.
Figure 5:
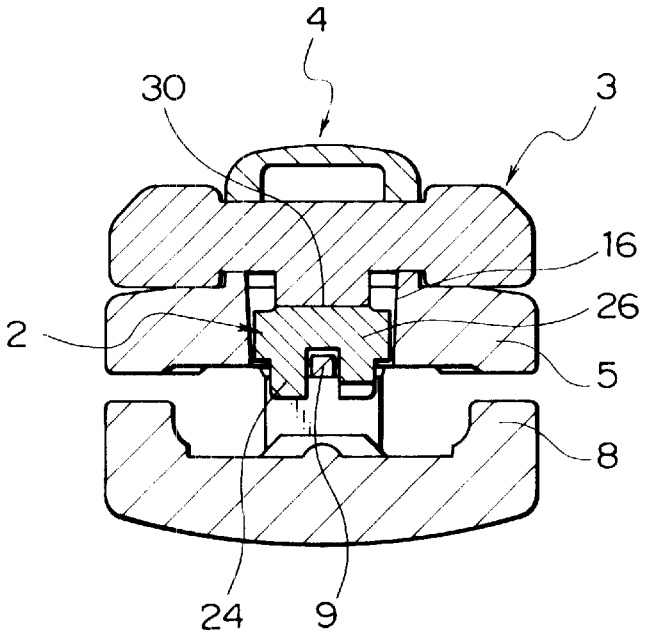
FIG. 5 is a lateral sectional view showing a state in which the locking mechanism of the slider is actuated.

As shown in FIGS. 1 and 4, the cover 4 is a rectangular prism and has cut-outs 34 provided in both side walls thereof so that the pintle 29 of the pull 3 tab can be inserted. Further, a rectangular engaging hole 35 is provided in the front and rear walls of the cover 4, so that the hook portion 18 of the engaging post 17 protruded in the slider body 1 is capable of being inserted and engaged with the engaging hole 35.

To assemble the slider with a locking mechanism as described above, the pawl body 2 is inserted into the recess 11 provided in the upper wing plate 5. While the insertion, the guide protruding portion 26 provided on the side wall 25 of the pawl body 2 is inserted into the recess 11 and guide grooves 16 provided in the side walls 15 of the supporting piece 14, so that the pawl body 2 is placed on the partitioning portion 9 of the bottom portion 12. After that, the pintle 29 of the pull tab 3 is placed on the supporting piece 14 of the slider body 1 from above the pawl body 2, and the cover 4 is mounted from above along the engaging posts 17. When the cover 4 is pressed, the engaging holes 35 engage the hook portions 18 of the engaging posts 17 by snap action. Consequently, the slider is assembled.

An operation of the assembled slider will be described. When it is intended to slide the slider on the fastener chain, if the pull tab 3 is raised, a contact between the pawl body 2 and cam 30 is released, so that the pawl body 2 is automatically pressed up by a repellent force exerted when the coil-shaped fastener elements E are returned to the original shape by elastic rebound. If the pull tab 3 is pulled forward with this condition, the slider can be slid freely so that the fastener chain can be closed. Further, if the raised pull tab 3 is hung relatively backward and pulled, the slider can be slid freely so that the fastener chain can be opened. Further, when stopping the slider, the pull tab 3 is hung backward as shown in FIG. 4 so that the cam 30 presses the pawl body 2. At the same time, the right and left locking pawls 24 are pressed in between the right and left coil-shaped fastener elements E, so that the slider cannot slide.

Figure 8:
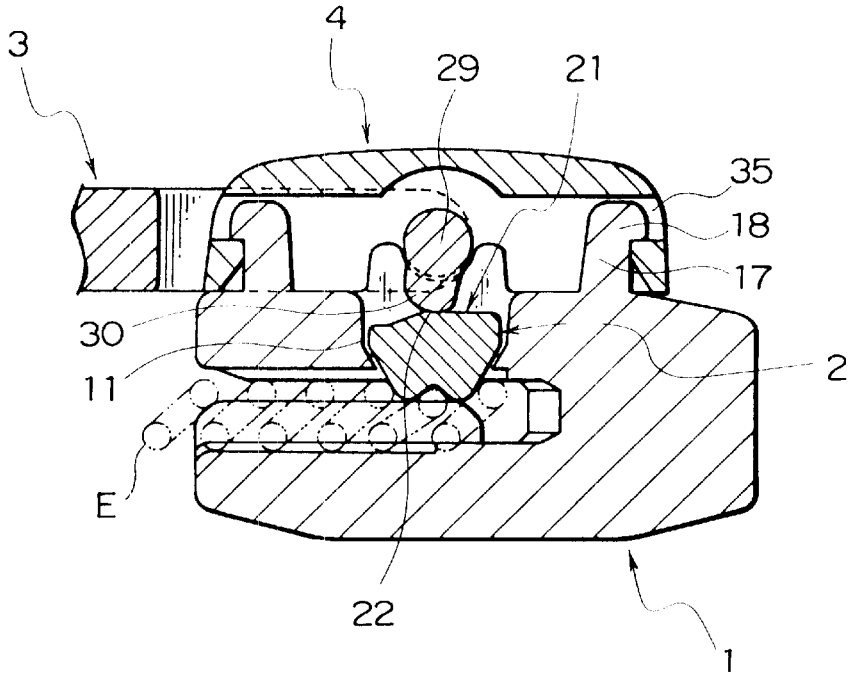
FIG. 8 is a longitudinal sectional view showing a state in which the locking mechanism is actuated by employing a modified pawl body in the slider.

FIG. 8 shows a modification of the pawl body 2 of the first embodiment. The vertex 22 is provided in the center of the top face 21 of the base portion 20 of the pawl body 2 such that it partitions to the front and rear portions. A front portion relative to the vertex 22 is formed in a horizontal plane and a rear portion relative to the vertex 22 is formed in an inclined shape. Therefore, a thickness of the front portion of the base portion 20 is different from that of the rear portion, and the thickness of the front portion is formed larger than that of the rear portion.

Figure 9:
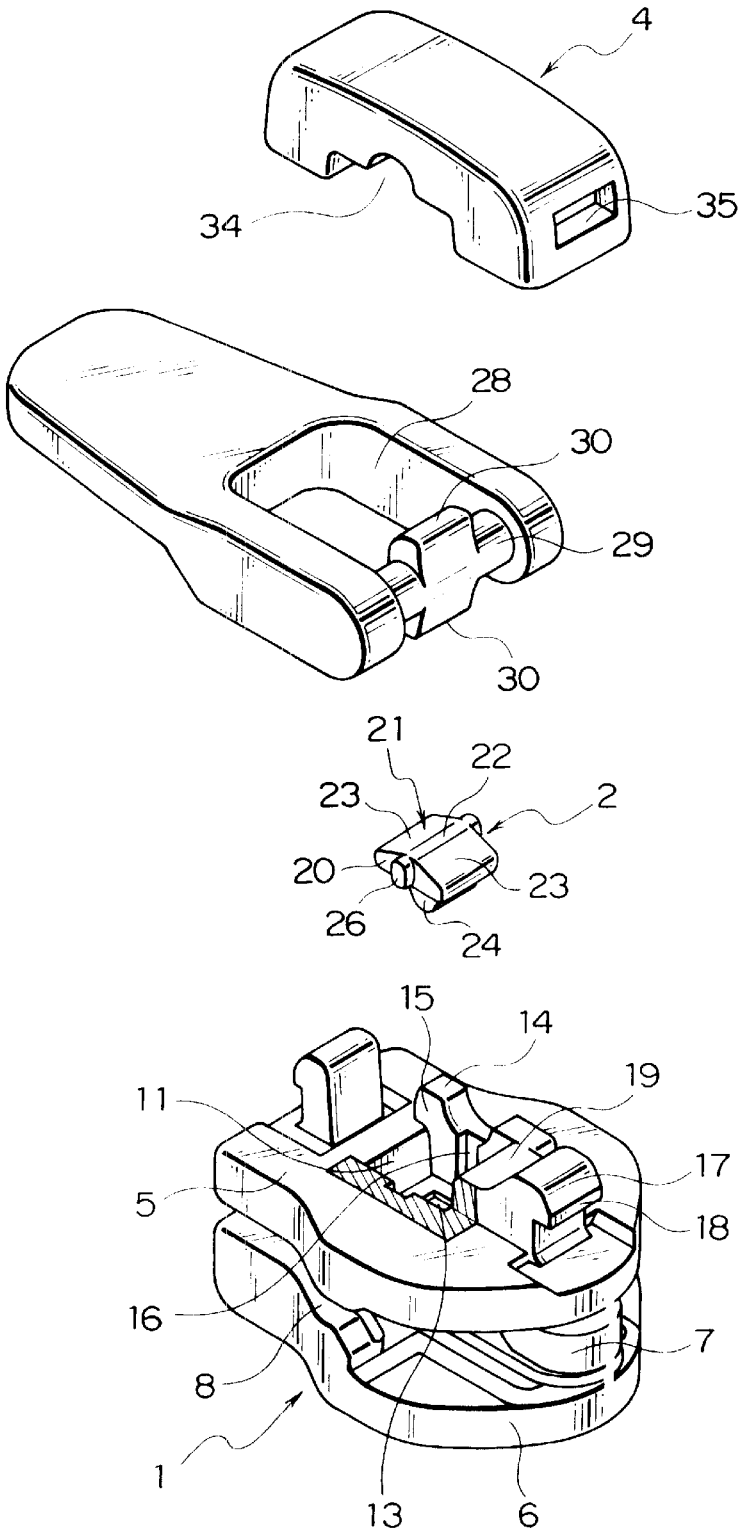
FIG. 9 is an exploded perspective view of a slider with locking mechanism according to a second embodiment.
Figure 10:
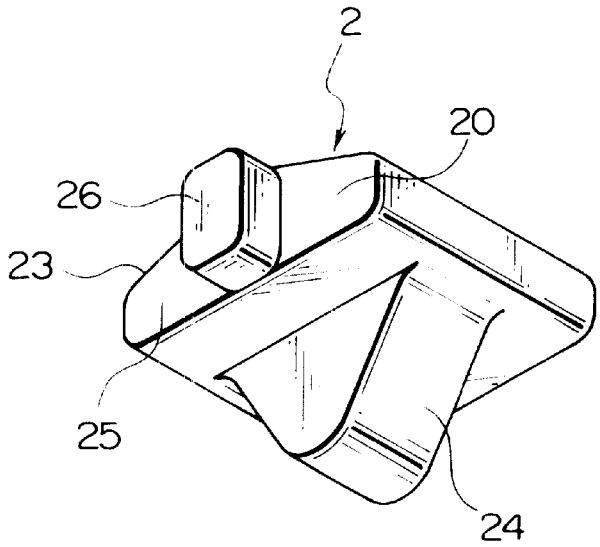
FIG. 10 is a perspective view of a pawl body of the same slider.
Figure 11:
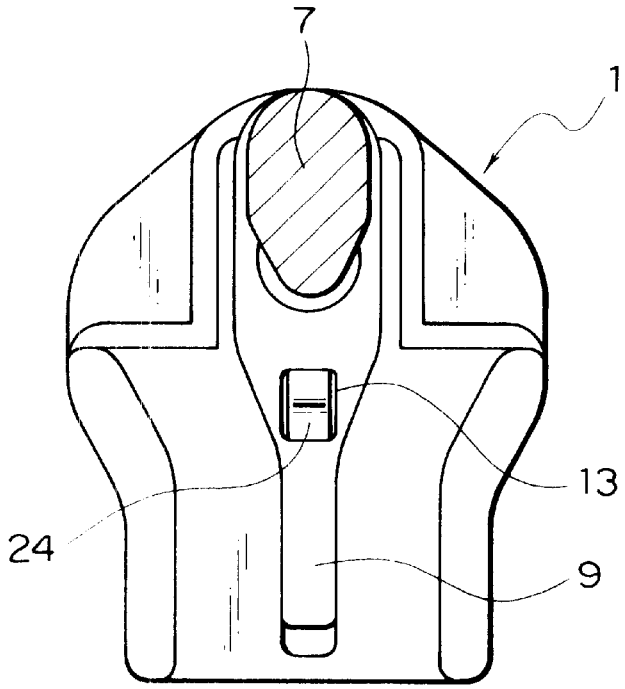
FIG. 11 is a sectional view showing an inner structure of an upper wing plate of the same slider.

A slider of the second embodiment shown in FIGS. 9 to 13 comprises a slider body 1, pawl body 2, pull tab 3 and cover 4, which are molded of the same thermoplastic resin material as the above described embodiment. In the slider body 1, an upper wing plate 5 and a lower wing plate 6 are connected with a guide post 7, and guide flanges 8 for guiding coil-shaped fastener elements E are provided so as to protrude on both side edges of the lower wing plate 6. Further, as shown in FIG. 11, a protruded partitioning portion 9 for partitioning right and left coil-shaped fastener elements E are provided in the center of an inside face of the upper wing plate 5 along the longitudinal direction thereof, and sliding grooves 10 for the coil-shaped fastener elements are provided between the upper wing plate 5 and lower wing plate 6. Then, a recess 11 is provided in the center of a top surface of the upper wing plate 5. This recess 11 is formed such that a bottom portion side 12 thereof is relatively narrow, and one pawl hole 13 is provided in a bottom portion 12 such that one locking pawl 24 provided on a bottom face of the pawl body 2 can be inserted. The pawl hole 13 is disposed in the partition wall 9 in the center portion.

Supporting pieces 14 for mounting the pintle 29 of the pull tab 3 are provided so as to protrude on both the right and left sides of the recess 11 provided in the top surface of the slider body 1. A top face of the supporting piece 14 is formed in an arc-shape so as to mount the pintle 29. Further, concave guide grooves 16 are provided vertically on both side walls 15 of the recess 11 toward the pawl hole 13. The guide grooves 16 extend up to inner faces of the supporting pieces 14 connected to the recess 11. Then, engaging posts 17 are provided on the front and back of the upper wing plate 5 of the slider body 1 so that a cover 4 can be set thereon by snap action such that they oppose each other. An outward facing hook portion 18 is provided at a front end of each of the engaging posts 17 and capable of engaging with an engaging hole 35 provided in the cover 4. A front engaging post 17 is formed in a large thickness up to an edge of the recess 11 and a deeper stepped portion 19 is provided on an edge of the recess 11 such that it is flush with a top face of the supporting piece 14.

As shown in FIGS. 9 and 10, the pawl body 2 is formed of a base portion 20 in which a bottom face thereof is flat and a top face 21 thereof is formed in a mountain shape protruding along a horizontal line in the center and has a vertex 22. Slopes 23 are formed on both sides of the front and back of the vertex 22 so that the cam 30 provided on the pull tab 3 is capable of making contact with the slopes 23. The locking pawls 24 are provided so as to protrude longitudinally in the center of the base portion 20. These locking pawls 24 are formed to have a constant width in the longitudinal direction and ends thereof are narrowed gradually.

A protrusion protruding in a vertical direction, or a guide protruding portion 26 is provided in each of side walls 25 of a base portion 20 of the pawl body 2. This guide protruding portion 26 is inserted into a recess 11 of the slider body 1 and a guide grooves 16 provided in the side wall 15 of the supporting piece 14 so that the pawl body 2 is capable of moving up and down with respect to the slider body 1 and the locking pawl 24 is capable of entering or escaping from the sliding grooves 10. Just before the right and left coil-shaped fastener elements E inserted through the sliding grooves 10 of the slider body 1 engage each other, the locking pawl 24 presses either of the right or left coil-shaped fastener elements E, or the locking pawl 24 is pressed up by a repellent force of either of the right or left fastener elements E.

The pull tab 3 may be formed in a rectangular shape as shown in FIG. 9 or in other arbitrary shapes. A concave hole 28 is provided in an end of the pull tab 3 so that the cover 4 can be inserted thereinto and the pull tab 3 can be raised or hung freely. A pintle 29 is provided so as to be mounted on the supporting pieces 14 of the slider body 1. A cam 30 having a substantially the same width as a lateral width of the top face 21 of the pawl body 2 is formed in the center of each face of the pintle 29 such that it protrudes vertically with respect to each of the faces of the pull tab 3 and can make contact with the top face 21 of the pawl body 2.

A sectional shape of the cam 30 of the pull tab 3 is formed in a symmetrical shape with respect to a vertical direction while a side view is just that of a thumb such that a front side of the sectional shape is substantially linear in both upper and lower portions thereof while an inner side thereof is arc-shaped. Then, when the cam 30 faces the pawl body 2, as shown in FIGS. 12 and 13, the front end 31 of each of the upper and lower portions of the cam 30 rides over the vertex 22 and maintained in a stabilized condition in a longitudinal direction of the slider body 1.

Figure 12:
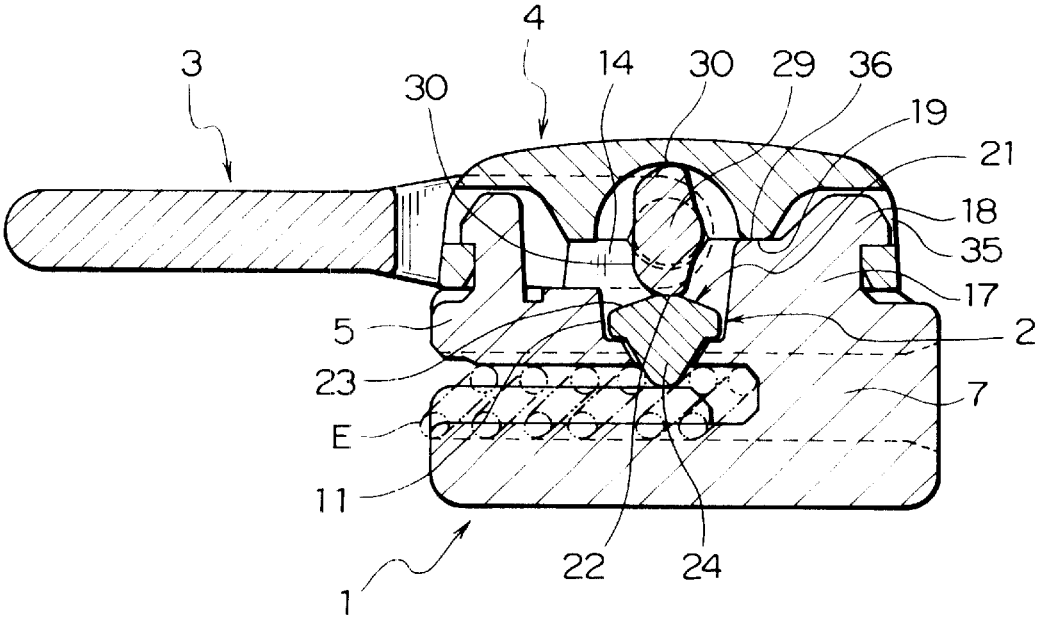
FIG. 12 is a longitudinal sectional view showing a state in which the locking mechanism of the same slider is actuated.
Figure 13:
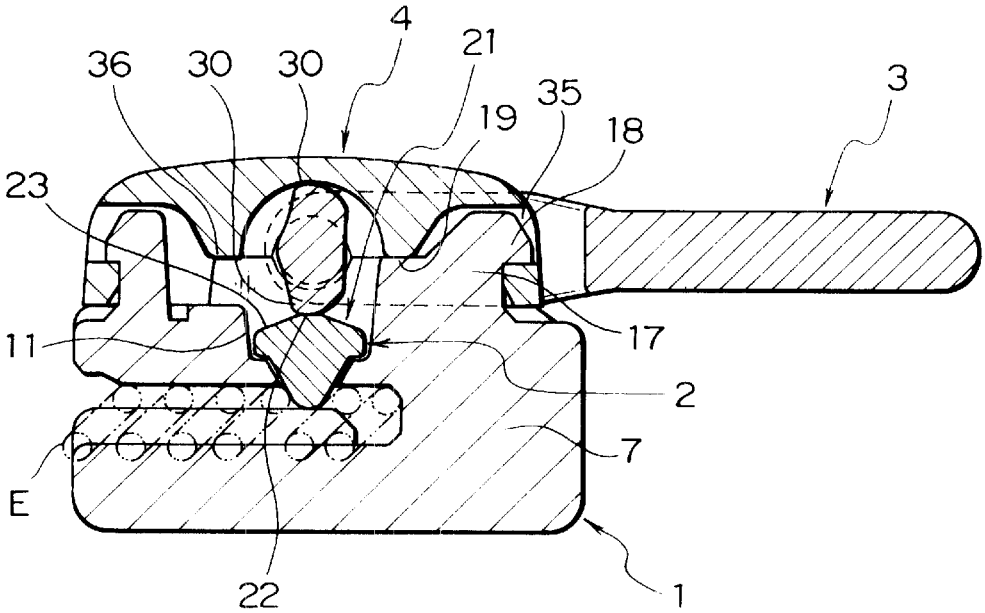
FIG. 13 is a longitudinal sectional view showing a state in which the locking mechanism of the same slider is actuated.

As shown in FIGS. 9 and 12, the cover 4 is a rectangular prism which has a cut-out 34 in each of both side walls so that the pintle 29 of the pull tab 3 can be inserted. Further, a rectangular engaging hole 35 is provided in each of the front and rear walls of the cover 4, so that the hook portion 18 of the engaging post 17 protruded on the slider body 1 can enter and engage with the engaging hole 35. A protruding portion 36 is provided in an inner ceiling portion of the cover 4 so that it can be placed on each of both side walls along the cut-out 34. When the cover 4 is set in the slider body 1, this protruding portion 36 is placed on the right and left supporting pieces 14 and a top face of the stepped portion 19 of the front engaging post 17.

In an assembly of the slider having such a locking mechanism, the pawl body 2 is inserted into the recess 11 provided in the upper wing plate 5 as mentioned above. When inserting the pawl body 2, the guide protruding portion 26 provided on the side wall 25 of the pawl body 2 is inserted into the recess 11 and guide grooves 16 provided in the side walls 15 of the supporting piece 14, so that the pawl body 2 is placed on the bottom wall of the bottom portion 12. After that, the pintle 29 of the pull tab 3 is placed on the supporting piece 14 of the slider body 1 from above the pawl body 2, and the cover 4 is mounted from above along the engaging posts 17 such that it makes contact with the supporting pieces 14 and the top face of the stepped portion 19. When the cover 4 is pressed, the engaging holes 35 of the cover 4 engage the hook portions 18 of the engaging posts 17 by snap. Consequently, the slider is assembled.

An operation of the assembled slider will be described. When sliding the slider on the fastener chain, raise the pull tab 3 and a contact between the pawl body 2 and cam 3 is released, so that the pawl body 2 is automatically pressed up by the repellent force of either of the right and left coil-shaped fastener elements E. When the pull tab 3 is relatively hung forward and pulled with this condition, the slider can be slid so that the fastener chain can be closed. Further, when the raised pull tab 3 is hung relatively backward and pulled, the slider can be slid backward so that the fastener chain can be opened. Further, when stopping the slider, the pull tab 3 is raised or hung forward or backward as shown in FIGS. 12 and 13 so that the cam 30 presses the pawl body 2. Then, the locking pawl 24 is pressed in between either the right or left coil-shaped fastener elements E which are just about to engage each other, so that the slider cannot slide.

Figure 14:
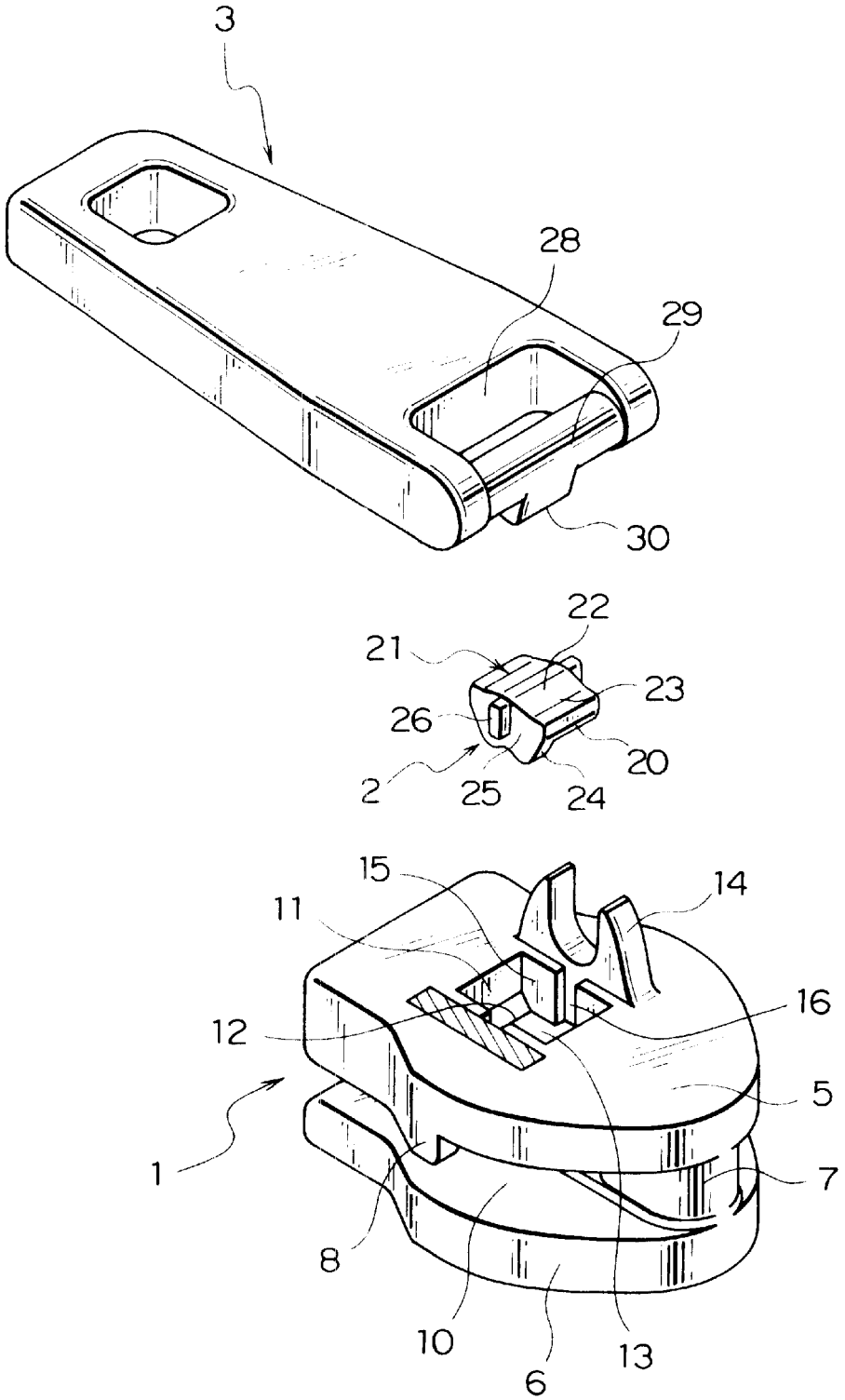
FIG. 14 is an exploded perspective view of a slider with locking mechanism according to a third embodiment.
Figure 15:
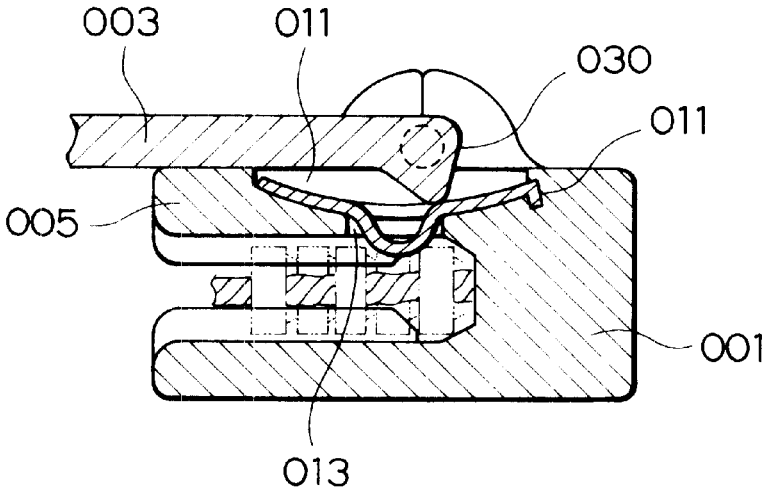
FIG. 15 (PRIOR ART)
FIG. 15 is a longitudinal sectional view showing a state in which the locking mechanism of a known slider with locking mechanism is actuated.
Figure 16:
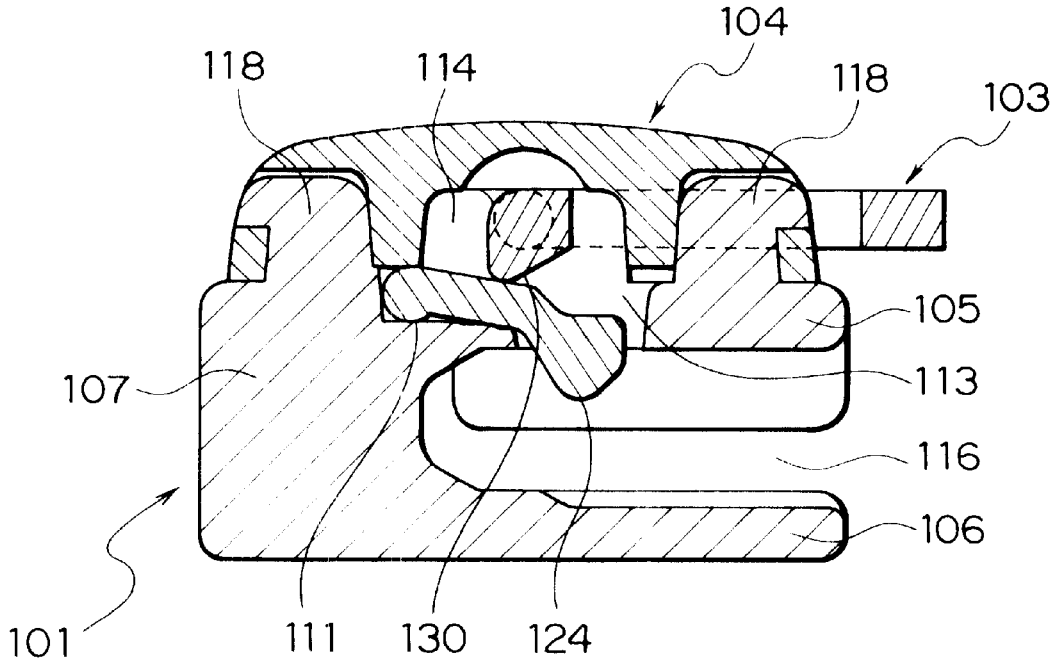
FIG. 16 (PRIOR ART)
FIG. 16 is a longitudinal sectional view showing a state in which the locking mechanism of another known slider with locking mechanism is actuated.

The slider of a third embodiment shown in FIG. 14 comprises a slider body 1, pawl body 2 and pull tab 3, which are molded by die-casting of metal such as aluminum alloy and zinc alloy. In the slider body 1, an upper wing plate 5 and a lower wing plate 6 are connected with a guide post 7 and guide flanges 8 for guiding coil-shaped fastener elements E are provided so as to protrude on both side edges of the upper wing plate 5. A partitioning portion 9 for partitioning right and left coil-shaped fastener elements E are provided so as to protrude in the center of an inner face of the upper wing plate 5 along the longitudinal direction thereof and sliding grooves 10 for the coil-shaped fastener elements are provided between the upper wing plate 5 and lower wing plate 6. A recess 11 is provided in the center of a top surface of the upper wing plate 5. This recess 11 is formed such that the bottom portion 12 side thereof is relatively narrow. Two pawl holes 13 are provided in the bottom portion 12 such that two locking pawls 24 provided on a bottom face of the pawl body 2 can be inserted. The pawl holes 13 are disposed in parallel to each other on both sides of the partitioning portion 9 in the center portion.

A concave guide groove 16 is provided vertically toward the pawl hole 13 in each of the side walls 15 on the right and left sides of the recess 11 provided in the top face of the slider body 1. Supporting pieces 14 are provided outside this guide groove 16 such that they stand on the top face of the upper wing plate 5. A top face of the supporting piece 14 is formed in a U shape so as to support the pintle 29 of the pull tab 3.

The pawl body 2 is the same shape as the pawl body 2 of the first embodiment, for example, the pawl body 2 shown in FIG. 2. The pawl body 2 is formed of a base portion 20 in which a bottom face thereof is flat and a top face 21 is formed in a mountain shape protruding along a horizontal line in a center thereof so as to form a vertex 22. Slopes 23 are formed on both sides of the front and back of the vertex 22, and an end portion of each slope 23 is formed in a horizontal plane such that the cam 30 provided on the pull tab 3 is capable of making contact with the slope 23. Two locking pawls 24 are provided in parallel on each of both the right and left side edges of the base portion 20 so that the locking pawls 24 project downward. Front ends of the locking pawls 24 are formed in a gradually narrowed shape. The right and left locking pawls 24 are deviated by half pitch to coincide with the pitch of each of the right and left coil-shaped fastener elements E. Front and rear entrances of the opposing locking pawls 24 are formed wider than an inner width.

Guide protruding portions 26 are provided on the side walls 25 of the pawl body 2, in other words, from a top portion of an external face of the locking pawl 24 up to the base portion 20 so as to protrude along a vertical direction thereof. This guide protruding portion 26 is inserted into the guide grooves 16 provided in each of the side walls 15 of the recess 11 of the slider body 1, so that the pawl body 2 is capable of moving vertically with respect to the slider body 1 and the locking pawls 24 are capable of entering or escaping from the sliding grooves 10. Consequently, the locking pawls 24 press the right and left coil-shaped fastener elements E inserted through the sliding grooves 10 of the slider body 1, and the pawl body 2 is pressed up by a repellent force of the coil-shaped fastener elements E.

The pull tab 3 is of rectangular shape and has a concave hole 28 provided in an end portion thereof such that a piece of the supporting piece 14 can be inserted and the pull tab 3 can be raised or hung freely. Further, the pintle 29 for mounting the supporting piece 14 is provided. A cam 30 having a substantially the same width as a lateral width of the top face 21 of the pawl body 2 is provided so as to protrude in the center of the pintle 29 perpendicular to the pull tab 3 so that it is capable of making contact with the top face 21 of the pawl body 2.

The cam 30 of the pull tab 3 has the same shape as the cam 30 of the first embodiment shown in FIG. 6 and a front end thereof is formed substantially linearly while an inner side is arc-shaped, and is similar to a side view of the thumb. A front end 31 of the cam 30 is deviated forward of the axis 32 of the pintle 29. When the pull tab 3 is fallen onto a top face on the rear side of the slider body 1, the front end 31 of the cam 30 rides over the vertex 22 of the pawl body 2 and is maintained in a stabilized condition.

Next, an assembly of the slider will be described. When the pawl body 2 is inserted into the recess 11 provided in the upper wing plate 5, the guide protruding portions 26 provided on the side walls 25 of the pawl body 2 are inserted into the guide grooves 16 provided in the side walls 15 of the recess 11. After that, the pintle 29 of the pull tab 3 is placed on the U-shaped supporting pieces 14 from above the pawl body 2 and then, both tips of the supporting pieces 14 are crimped inward so as to hold the pintle 29 rotatable freely on the supporting pieces 14 and the pull tab 3 can be raised or hung freely with respect to the slider body 1. The cam 30 is formed to be capable of making contact with the top face 21 of the pawl body 2. Consequently, the slider with locking mechanism is assembled.

An operation of the assembled slider will be described below. When sliding the slider on the fastener chain, a contact between the pawl body 2 and cam 30 is released by raising the pull tab 3. Consequently, the pawl body 2 is automatically pressed up by a repellent force exerted when the coil-shaped fastener elements E return to the original shape by an elastic reversion. If the pull tab 3 is pulled forward with this condition, the slider can be slid so that the fastener chain can be closed. When the raised pull tab 3 is inclined slightly backward and pulled, the slider can be slid to open the fastener chain. Further, when stopping the slider, if the pull tab 3 is fallen backward, the pawl body 2 is pressed by the cam 30, and the right and left locking pawls 24 enter in between the right and left coil-shaped fastener elements E with a pressure, so that the slider cannot slide.

In the sliders for slide fastener with locking mechanism described above, it is permissible to change the components of the first embodiment or components of the second embodiment or components of the third embodiment and combine those different components appropriately.

The slider for slide fastener with locking mechanism of the present invention has the above described feature and exerts the following effects with such a feature.

There is provided a slider for slide fastener with locking mechanism, wherein a recess 11 is provided in the center of the surface of an upper wing plate 5; pawl holes 13 for locking pawls 24 are made in a bottom portion 12 of the recess 11; a pawl body 2 made of non-elastic material having the locking pawls 24 on a bottom thereof is mounted to the recess 11 movable vertically so that the locking pawls 24 are capable of advancing or retreating through the pawl holes 13; and a pull tab 3 is supported by supporting pieces 14 of a slider body such that a cam 30 provided on an end of the pull tab 3 is kept in contact with a top face 21 of the pawl body 2. Therefore, the locking mechanism which is actuated in the direction of the right angle to the fastener element row by raising or hanging the pull tab 3 can be assembled easily with a simple structure.

A guide protruding portion 26 is protruded vertically on both side walls of the pawl body 2, a recessed guide groove 16 is provided in both side walls 15 of the recess 11 or recess 11 and supporting pieces 14 along a vertical direction thereof, and the guide protruding portions 26 are inserted into the guide grooves 16 to be slidable freely. Therefore, the locking mechanism can be reduced in size, so that the slider itself can be also reduced in size and the locking mechanism can be operated accurately and smoothly.

The top face 21 of the pawl body 2 is formed in a mountain shape protruding along a horizontal line in the center so as to produce a vertex 22, one face of the cam 30 of the pull tab 3 is formed substantially linear while the other face is formed in an arc-shape and when the pull tab 3 is fallen to the back, a front end of the cam 30 rides over the vertex 22, while when the pull tab 3 is raised, the cam 30 makes contact with slopes 23 of the pawl body 2 and the pull tab 3 is urged so that it cannot be fallen freely. Thus, the shape of the cam 30 is suitable for the pawl body 2 which moves up and down, so that the pawl body 2 can be actuated properly. Further, it never happens that the locking mechanism is released unintendedly to allow the slider to slide, and once the locking mechanism is released, it is not activated unless a locking operation is carried out.

A partitioning portion 9 is provided in a longitudinal direction in the center of an inner face of the upper wing plate 5 so as to protrude, pawl holes 13 are made on both sides of the partitioning portion 9, the locking pawls 24 are provided in parallel so as to protrude from both sides of a bottom face of the pawl body 2 except a longitudinal direction in the center thereof and the locking pawls 24 and pawl holes 13 are disposed so as to face each other. Thus, the locking mechanism acts on the right and left fastener element row equally so that an excellent locking function can be exerted.

The locking pawls 24 provided on the right and left sides of the bottom face of the pawl body 2 so as to protrude are deviated by half pitch so as to correspond to a pitch of right and left fastener elements. Thus, the locking mechanism coincides with the right and left fastener element rows so that an efficient locking function can be exerted without damaging the fastener elements.

A partitioning portion 9 is provided in a longitudinal direction in the center of an inner face of the upper wing plate 5 so as to protrude, a pawl hole 13 is made in the partitioning portion 9, a locking pawl 24 is provided in the center of a bottom face of the pawl body 2 so as to protrude, and the locking pawl 24 and pawl hole 13 are disposed so as to oppose each other. Therefore, the locking mechanism provided in the center acts on either the right or left fastener elements, so that an excellent locking function can be exerted.

The cams 30 provided on an end of the pull tab 3 are formed such that they protrude from both front and rear surfaces of the pull tab 3 symmetrically with respect thereto and are capable of making contact with both slopes 23 formed on the top face 21 of the pawl body 2 when the pull tab 3 is fallen. Therefore, the pawl body 2 capable of moving up and down is activated by falling operation of the pull tab 3 forward or backward, so that an excellent locking function can be exerted. Consequently, a slide fastener having an ideal locking mechanism can be produced. Thus, the effects which the present invention exerts are very remarkable.

What is claimed is:

1. A locking slider for a slide fastener, the slider comprising:

a locking mechanism;

a slider body, the slider body having an upper wing plate with a recess provided on a surface thereof, a bottom portion of the recess being provided with pawl holes for locking pawls of a pawl body of the locking mechanism; the pawl body being mounted to the recess and movable vertically so that the locking pawls are capable of advancing or retreating through the pawl holes; and a pull tab being supported by supporting pieces of the slider body such that a cam provided on an end of the pull tab is kept in contact with a top face of the pawl body.

2. The locking slider for a slide fastener of claim 1, further comprising:

a guide protruding portion provided on a side wall of the pawl body such that it protrudes from the side wall; and recessed guide grooves provided in a side wall of the recess and configured along a vertical direction thereof to slidably accept the guide protruding portion.

3. The locking slider for a slide fastener of claim 1, wherein at least one of both sides of a vertex bisecting the top face of the pawl body slopes downward.

4. The locking slider for a slide fastener of claim 1, wherein the top face of the pawl body is formed with a protrusion protruding along a vertex bisecting the top face of the pawl body and the protrusion has slopes inclining downward at opposite sides thereof.

5. The locking slider for a slide fastener of claim 1, wherein one face of the cam is formed substantially linear while another face of the cam is formed substantially arc-shaped, and wherein when the pull tab is fallen to one side of the pawl body, a front end of the cam rides over a vertex along the top face of the pawl body.

6. The locking slider for a slide fastener of claim 1, further comprising a partitioning portion provided in a longitudinal direction in the center of an inner face of the upper wing plate so as to protrude, wherein pawl holes are provided on both sides of the partitioning portion, wherein the locking pawls are provided in parallel so as to protrude from both sides of a bottom face of the pawl body, and wherein the locking pawls and the pawl holes provided on both sides of the partitioning portion are disposed so as to face each other.

7. The locking slider for a slide fastener of claim 6, wherein the locking pawls protruding from opposite sides of a bottom face of the pawl body are staggered so as to correspond to opposite sides of a pair of right and left fastener elements.

8. The locking slider for a slide fastener of claim 1, further comprising a partitioning portion provided in a longitudinal direction in the center of an inner face of the upper wing plate so as to protrude, wherein a pawl hole is made in the partitioning portion, wherein a locking pawl is provided in a bottom face of the pawl body so as to protrude, and wherein the locking pawls and the pawl hole made in the partitioning portion are disposed so as to face each other.

9. The locking slider for a slide fastener of claim 1, wherein cams provided on an end of the pull tab are formed such that they protrude from both front and rear surfaces of the pull tab symmetrically with respect thereto, and are capable of making contact with each one of slopes formed on the top face of the pawl body alternately when the pull tab is fallen.

* * * * *